US006688071B1

(12) United States Patent
Evers et al.

(10) Patent No.: US 6,688,071 B1
(45) Date of Patent: Feb. 10, 2004

(54) CONCRETE STRUCTURE COMPRISING ANCHOR RODS AND ANCHOR ROD

(75) Inventors: Hermanus Johannes Josef Evers, Hengelo (NL); Robertus Cornelis Maria Van Rijn, Vinkeveen (NL)

(73) Assignee: Connector Vinkeveen B.V., Vinkeveen (NL)

( * ) Notice: Subject to any disclaimer, the term of this patent is extended or adjusted under 35 U.S.C. 154(b) by 0 days.

(21) Appl. No.: 10/019,096

(22) PCT Filed: Jun. 22, 2000

(86) PCT No.: PCT/NL00/00435

§ 371 (c)(1),
(2), (4) Date: Feb. 13, 2002

(87) PCT Pub. No.: WO00/79071

PCT Pub. Date: Dec. 28, 2000

(30) Foreign Application Priority Data

Jun. 22, 1999 (NL) ..... 1012410

(51) Int. Cl.[7] ..... E04C 3/30

(52) U.S. Cl. ..... 52/740.1; 52/740.2; 52/740.3; 52/583.1

(58) Field of Search ..... 52/583.1, 740.2, 52/740.3, 740.1; 403/307; 411/387.2, 387.1, 82, 930

(56) References Cited

U.S. PATENT DOCUMENTS 549,973 A * 11/1895 Meyer ..... 83/464
573,653 A * 12/1896 Hansen ..... 101/233
4,393,638 A * 7/1983 Sell et al. ..... 52/704
4,619,096 A * 10/1986 Lancelot, III ..... 52/726.1
4,649,729 A 3/1987 McDowell et al. ..... 72/185
4,907,928 A * 3/1990 Beck et al. ..... 411/356
4,959,940 A * 10/1990 Witschi ..... 52/583.1
5,054,146 A 10/1991 Wiesenfeld et al. ..... 10/27 E
5,152,118 A 10/1992 Lancelot ..... 52/726
5,561,956 A * 10/1996 Englekirk et al. ..... 52/223.13
5,653,563 A * 8/1997 Ernst et al. ..... 411/82
5,729,952 A * 3/1998 Dahl ..... 52/740.7
6,029,417 A * 2/2000 Leibhard et al. ..... 52/705
6,099,196 A * 8/2000 Lancelot, III ..... 403/313
6,192,647 B1 * 2/2001 Dahl ..... 52/726.1
6,286,270 B1 * 9/2001 Gruson et al. ..... 52/155
6,367,205 B2 * 4/2002 Cornett, Sr. ..... 52/23

FOREIGN PATENT DOCUMENTS

EP 0 059 680 A2 9/1982
EP 0 816 584 A1 1/1998

* cited by examiner

*Primary Examiner*—Kimberly Wood
(74) *Attorney, Agent, or Firm*—Paul Davis; Heller Ehrman White & McAuliffe

(57) ABSTRACT

An anchor rod having at least one section provided with ribs or other raised portions or profiling and a threaded section at one or both ends, and having a variable transition section between the threaded section(s) and the profiled section; and a method of making the anchor rod.

8 Claims, 2 Drawing Sheets

CONCRETE STRUCTURE COMPRISING ANCHOR RODS AND ANCHOR ROD

Figure 1:
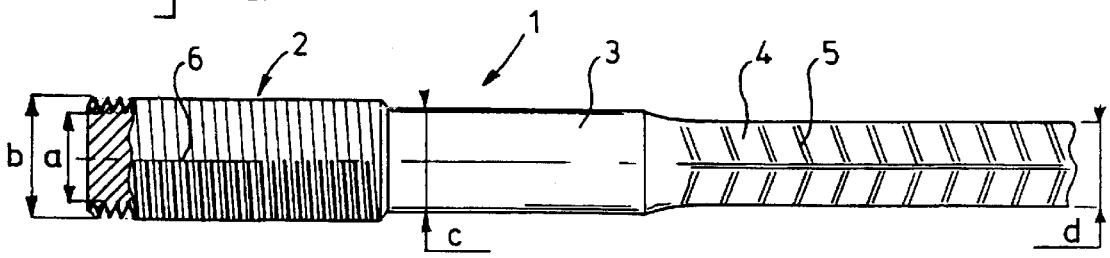

The present invention relates to a concrete structure comprising at least two anchor rods coupled to one another, at least one of said anchor rods being provided with an external thread for that coupling. Such structures are generally known in the art. When producing large concrete structures it is frequently not possible to pour these in one piece. Therefore these are poured successively in parts. What is important here is that the reinforcement does form an essentially continuous structure. It is therefore customary in the art to fit, close to the boundary of the first part to be poured, a reinforcing rod provided with, for example, a threaded bush at the boundary surface. After pouring the casing is removed and the opening to the thread is exposed and an anchor rod, provided with an external thread, is screwed into this opening. The second part is then poured in contact with the first part and the strength of the structure is guaranteed by the connection continuing through the structure.

Stringent requirements are imposed on the anchor rods used.

In general such rods are produced by using reinforcing steel that has already been provided with raised portions or ribs as the starting material. After cutting to size, the relevant end of the reinforcing steel that has to be provided with a thread is butted. After all, insufficiency in cross-section at the location of the thread is not acceptable in a linking system. Butting of steel is carried out by heating the steel. By this means a substantial proportion of the material structure that was originally longitudinally oriented will be modified. After butting the material must be cooled under controlled conditions. It has been found that as a result of the increasingly extensive alloying of reinforcing steel, on the one hand, and the acceptance of an ever higher percentage of impurities (scrap) on the other hand, an inadmissible reduction in strength can occur if there is the slightest deviation from the norm for quenching. In particular this causes cracking. No problems have been found in the case of normal applications of reinforcing steel, that is to say where no heating and butting takes place, but the above-mentioned problems are observed as soon as anchors provided with thread have to be produced.

It will be understood that cracking can ultimately lead to failure, which can have major consequences for structures in which such anchor rods can be used. Moreover, such anchor rods are used in prefabricated concrete components, as a result of which lifting slings and the like can be attached in a simple manner to the anchor rod. This gives rise to stress especially when moving the prefabricated elements concerned and failure can also have disastrous consequences here.

On the other hand, it is extremely important that anchor rods have a relatively low price for a relatively high quality.

EP 0816584A1 discloses a screw coupling for anchor rods having the features of the preamble of claim 1.

The aim is to eliminate the disadvantages known from the prior art with an improved anchor rod being placed in a concrete structure and with failure being virtually precluded.

This aim is achieved with a concrete structure as described above by the characterising measures according to claim 1.

The material structure of a metal anchor rod is understood to be, inter alia, the molecule/fibre/grain orientation of the material concerned.

It is pointed out that an anchor bolt is disclosed in U.S. Pat. No. 5,054,146. This bolt must be used in particular for anchoring the rod in boreholes, openings or the like made in rocky soils. The anchor rod concerned is introduced into such an opening and a synthetic resin material is then used to provide for adhesion between the rod and the surroundings. This anchor rod is provided with a pattern consisting of flattened sections pressed in of the material. These lobes serve as stirrers for stirring the resin by means of which the anchor rod is fixed to the structure.

Using the anchor rod according to the present invention it is possible to make concrete structures with which the risk of failure of the anchor rods is avoided as far as possible.

The pattern used according to the invention is a pattern that is customary for reinforcing steel, that is to say of shallow height and produced with a gradual transition with respect to the other part of the anchor material. This pattern is obtained with the aid of a simple rolling operation, which can be combined with the reduction in the circumference of the anchor rod.

According to an advantageous embodiment of the invention, the concrete structure comprises a first poured part with an anchor rod fitted therein, the end of which anchor rod is provided with an internal thread by means of which the one anchor rod is coupled, said one anchor rod is fitted in a second part poured in contact with said first poured part. Said internal thread can be implemented by means of a bush clamped on the anchor rod. However, it is also possible to use a rod material of relatively large diameter as the starting material, the external diameter approximately corresponding to the external diameter of the part in which the internal thread has to be made. The diameter of the other part of the rod is then reduced to a very appreciable extent in order to obtain the desired dimensions.

According to the invention such an anchor rod is preferably produced by providing a method for the production of an anchor rod comprising the provision of a length of steel rod, making a thread at one end and making a pattern on the other part of the rod, wherein the thread is preferably made by rolling a thread and wherein the pattern is made by rolling the relevant part of the rod after making the thread. Instead of rolling a thread, cutting can also be used. In such a case it is preferable to reduce the diameter of that part where there is no thread, and where the pattern has to be applied, by rolling. The strength and other mechanical properties improve as a result of this rolling operation. Pattern or relief is understood here to be any surface structure or raised portion by means of which the engagement of the anchor rod and the surrounding concrete is promoted.

According to the invention no longer a length of reinforcing steel is used as the starting material and a section of enlarged diameter is provided for the thread by butting, but that using a section of rod material the section provided with a pattern or ribs is obtained by rolling. That is to say the difference in diameter between the section provided with a thread and the section provided with a pattern is obtained not by increasing the diameter at the section provided with a thread but by reducing the diameter of the section provided with a pattern. It has been found that during such a rolling operation, which can be carried out cold, the mechanical properties of the anchor rod only improve and do not deteriorate in any way. Consequently it is possible to use a relatively low grade steel and nevertheless to achieve adequate strength as required in accordance with the standards.

Because butting now no longer takes place, the material structure of the steel in the core at the threaded section will be unchanged, that is to say will essentially match that of the original material structure of said anchor rod.

Using the method described above it is possible in a simple manner to produce anchor rods with relatively high strength from relatively low-alloy materials. Examples of such materials are types of steel which have a relatively high carbon content. Because, in contrast to the prior art, it is not necessary to carry out an annealing treatment with deformation (warm butting) in order to produce a thread, the structure of the steel material is not affected or is barely affected by the method according to the present invention.

Because it is now possible inexpensively to produce anchor rods from material of high strength, it is possible in the case of some applications to replace relatively thick anchor rods made of conventional steel by appreciably thinner anchor rods made of high-tensile material. In the case of structures subjected to heavy load, there is often the problem that anchor rods are close to one another, as a result of which it can no longer be guaranteed that concrete material, and in particular the aggregate contained therein, infiltrates between the reinforcing rods and thus provides adequate strength. By, in accordance with the invention, using reinforcing rods of high strength which have a relatively small diameter the infiltration of concrete material is guaranteed.

A further increase in the strength of the structure can be obtained by producing the thread by rolling. After all, a similar thread can be obtained with a smaller starting diameter. The diameter of the transition section will be smaller than the external diameter of the threaded section. Of course, as a result of the rolling, the material structure of steel in the thread will deviate from the initial structure of the anchor rod, but this has no effect on the material structure in the core thereof. If a thread is cut, the other section of the anchor rod can be cold-rolled in the manner described above without any problem.

According to the invention the section provided with a pattern has a very appreciable length compared with the length of the section provided with a thread.

The pattern can be any pattern known in the prior art, such as raised portions or ribs. These can be introduced simply during rolling using a profiling roller.

If the thread is used in combination with a bush, which can be either a separate coupling bush or a bush fitted on the end of another anchor rod, it can be advantageous for the transition section to have a shoulder against which such a bush bears, or to be fitted in a seating surrounding the shoulder.

The anchor rod described above can be produced from any steel material known in the state of the art, which material can be either structural steel or stainless steel. St 52.3, which is a type of steel which is relatively easy to obtain and has relatively high purity, is mentioned by way of example.

As indicated above, types of steel of relatively high strength, that is to say with tensile strengths of, for example, 1,100 N/mm$^2$, can also be used.

Figure 2A:
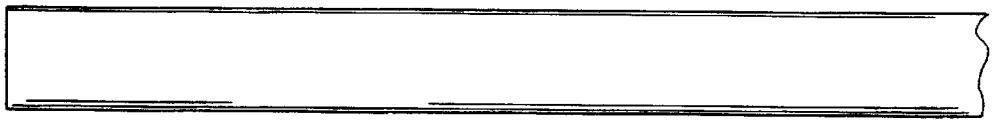
Figure 2B:
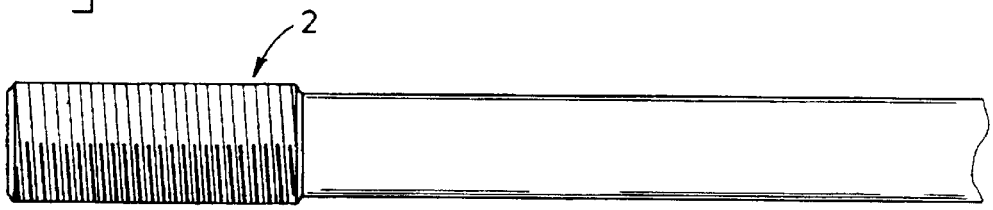
Figure 2C:
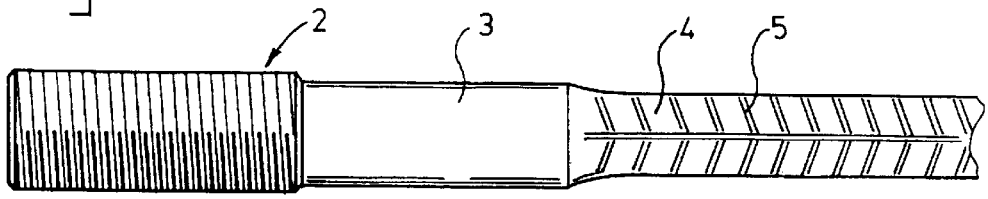
Figure 3:
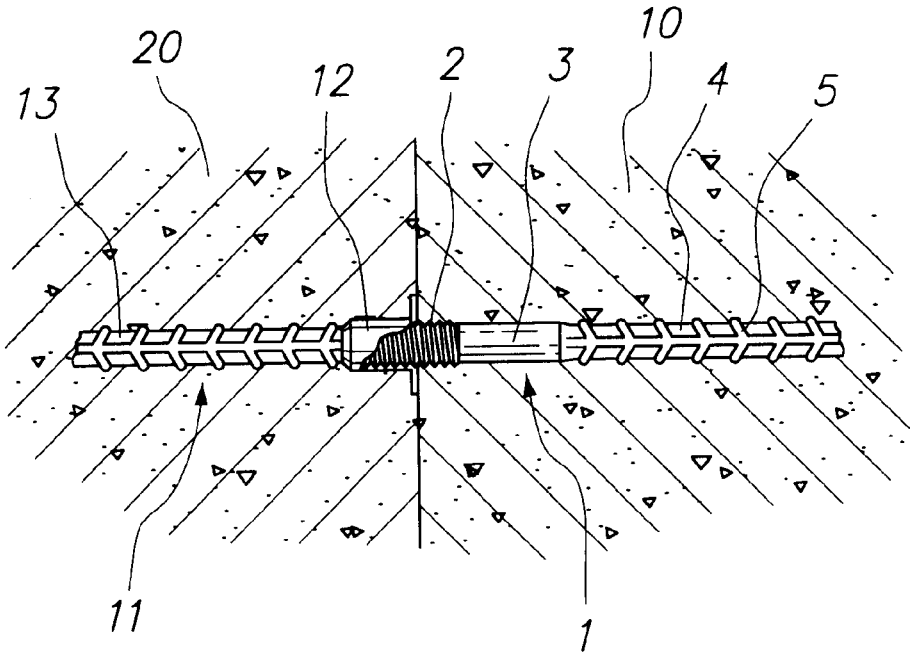

The invention will be explained below with reference to illustrative embodiments shown in the drawing. In the drawing:

FIG. 1 shows a diagrammatic view of an anchor rod according to the invention;

FIGS. 2*a*–2*c* show the various steps for the production of the anchor rod shown in FIG. 1; and FIG. 3 shows a concrete structure using an anchor rod of this invention.

In FIG. 1 an anchor rod according to the invention is indicated in its entirety by 1. This anchor rod consists of a section 2 provided with a thread, an adjoining transition section of desired length 3 and a section 4 provided with a pattern. Section 4 is shown broken off in the drawing and can have an appreciable length. (In general the length of section 4 will make up at least 90% of the total length of the anchor rod). The raised portions are indicated by 5 and consist of ribs which extend over approximately one quarter of the periphery of the rod and which are at an angle with respect to the longitudinal axis 6 of the rod. These ribs can, of course, be differently oriented. In FIG. 1*a* indicates the core diameter of the thread 2 produced by rolling, b indicates the external diameter, which is greater than the diameter c of the transition section 3. Diameter section d, that is to say the core diameter of the section 4 provided with a pattern, is once again less than the diameter of section c.

FIG. 2 shows diagrammatically how such an anchor rod is produced. The starting material, for example a smooth rod of material, for example ST 52.3 material, is shown in FIG. 2*a*. Thread 2 is made by rolling, as is indicated in FIG. 2*b*. On the one hand the diameter of the rod decreases from c to a in this location but, on the other hand, material is forced outwards, as a result of which the external diameter of the thread b becomes greater than the diameter of the starting material.

A rolling operation is then carried out to obtain section 4. During this operation the diameter of the section adjoining transition section 3 is reduced. The final core diameter is indicated by d. The ribs 5 can also be produced during rolling.

For the production of an anchor rod with an M16 thread a rod as shown in FIG. 2*a* with a diameter of 14.55 mm can be used as starting material. In the finished rod the transition section 3 will have a dimension c of 14.55 mm whilst threaded section 2 is an M16 thread rolled in the conventional manner. In this embodiment d can be between 11.55 and 13.55 mm. The strength of this section increases as a result of rolling.

The steps described above can also be carried out in a different sequence or simultaneously. A better controllable process is obtained with the method described above. After all, rolling is appreciably less critical than butting at high temperature and the subsequent quenching or other heat treatment. Moreover, this method is relatively simple to carry out. Because the production process is simpler, in principle it is possible to use a better starting material for the same finished price. Moreover, it is possible to use the method with types of steel with which inadmissible structural modifications, which are not easy to change, take place on heating. Such structural modifications can have a highly adverse effect on the properties of the steel. By way of example, stainless steels and very high-tensile steels are used. Moreover, it is possible to make the anchor rods of appreciable length, such as up to 12 meters. It is hardly possible to handle such long lengths with the butting technique.

By means of the rolling operation it is possible to produce flat surfaces and the like on the anchor section concerned. Moreover, a wide variety of profiles can be produced. This is in contrast to the prior art where the starting material used is reinforcing iron produced in large batches, virtually no variations in which are known. Moreover, it is possible during rolling to produce other raised portions, grooves and the like extending over the entire length of the rolled section.

FIG. 3 shows a concrete structure using an anchor rod of this invention. In the Figure, a first anchor rod is an anchor rod of this invention shown generally at 1, having a threaded end section 2, a transition section 3, and a section 4 provided with a pattern 5, as shown previously in FIGS. 1 and 2*c*. A second anchor rod shown generally at 11, having a coupling 12 having an internal thread at one end and a patterned section 13 is embedded in a first poured concrete part 20, with the end of the coupling accessible from the surface of the first poured concrete part 20 so that the first anchor rod 1 can be connected thereto. The threaded end section 2 of the first anchor rod 1 engages with the internal thread of the coupling 12 of the second anchor rod 11. A second poured concrete part 10, poured in contact with the first poured concrete part 20, surrounds the first anchor rod 1, which is embedded in that second poured concrete part 10.

It will be understood that the various dimensions a–d mentioned above are dependent on the desired end product. Variations will be immediately obvious to those skilled in the art and fall within the scope of the appended claims.

We claim:

1. A poured concrete structure comprising first and second parts poured in contact one with another, comprising:

(A) the first part of the structure poured about a first anchor rod, the first anchor rod being provided with a coupling having an internal thread at a boundary with a second part of the structure;

(B) the second part of the structure poured about a second anchor rod, the second anchor rod being coupled to the first anchor rod by engagement with the thread of the coupling of the first anchor rod, the second anchor rod having a longitudinal axis and comprising:

(a) a threaded section having a core and an external thread thereon having an external thread diameter and engaging with the coupling, the material structure of the core of the threaded section substantially coinciding with the longitudinal axis of the rod, (b) a patterned section having a core with a patterned section core diameter and a pattern comprising raised portions thereon, and (c) a transition section between and joining the threaded section and the patterned section, the transition section having an essentially smooth outer surface and having a transition section diameter that is greater than the patterned section core diameter.

2. The concrete structure of claim 1, where the threaded section of the second anchor rod comprises a rolled thread.

3. The concrete structure of claim 1, where the threaded section of the second anchor rod comprises a cut thread.

4. The concrete structure of claim 1, where the transition section diameter of the second anchor rod is smaller than the external thread diameter.

5. The concrete structure of claim 1, where the second anchor rod has a rod length and the patterned section has a patterned section length that is more than 80% of the rod length.

6. The concrete structure of claim 1, where the pattern of the patterned section of the second anchor rod comprises a large number of elongated raised portions each extending at an angle to the longitudinal axis of the rod and having a length that is less than a circumference of the patterned section.

7. The concrete structure of claim 1, where the transition section of the second anchor rod has a shoulder.

8. A method for the production of a concrete structure comprising successively pouring parts of the structure in contact one with another, the method comprising:

(A) pouring a first part of the structure about a first anchor rod, the first anchor rod being provided with a coupling having an internal thread at a boundary with a volume that will become a second part of the structure;

(B) coupling to the first anchor rod by engagement with the thread of the coupling of the first anchor rod a second anchor rod, the second anchor rod having a longitudinal axis and comprising:

(a) a threaded section having a core and an external thread thereon having an external thread diameter and engaging with the coupling, the material structure of the core of the threaded section substantially coinciding with the longitudinal axis of the rod, (b) a patterned section having a core with a patterned section core diameter and a pattern comprising raised portions thereon, and (c) a transition section between and joining the threaded section and the patterned section, the transition section having an essentially smooth outer surface and having a transition section diameter that is greater than the patterned section core diameter; and (C) pouring the second part of the structure about the second anchor rod.

* * * * *